US009914564B2

(12) United States Patent
Giraud

(10) Patent No.: US 9,914,564 B2
(45) Date of Patent: Mar. 13, 2018

(54) DISPENSER

(75) Inventor: Jean-Pierre Giraud, Auburn, AL (US)

(73) Assignee: CSP TECHNOLOGIES, INC., Auburn, AL (US)

( * ) Notice: Subject to any disclaimer, the term of this patent is extended or adjusted under 35 U.S.C. 154(b) by 126 days.

(21) Appl. No.: 14/237,373

(22) PCT Filed: Jul. 17, 2012

(86) PCT No.: PCT/US2012/047001

§ 371 (c)(1),
(2), (4) Date: Mar. 31, 2014

(87) PCT Pub. No.: WO2013/022564

PCT Pub. Date: Feb. 14, 2013

(65) Prior Publication Data

US 2014/0203035 A1 Jul. 24, 2014

Related U.S. Application Data

(60) Provisional application No. 61/521,148, filed on Aug. 8, 2011.

(51) Int. Cl.

| | |
|---|---|
| ***B65H 1/00*** | (2006.01) |
| ***B65D 35/28*** | (2006.01) |
| ***B65D 83/04*** | (2006.01) |

(52) U.S. Cl.

CPC ..... *B65D 35/28* (2013.01); *B65D 83/0409* (2013.01); *B65D 2583/005* (2013.01);
(Continued)

(58) Field of Classification Search

CPC .... B65D 35/38; B65D 35/28; B65D 83/0409; B65D 2583/005; B65D 2583/0436; B65D 2583/0481; B65D 2583/049
(Continued)

(56) References Cited

U.S. PATENT DOCUMENTS 676,798 A * 6/1901 Mullins ..... B65D 83/02 221/196
683,053 A * 9/1901 Kottusch ..... A24F 15/10 221/142

(Continued)

FOREIGN PATENT DOCUMENTS

WO 2010/060546 A1 6/2010

*Primary Examiner* — Rakesh Kumar
(74) *Attorney, Agent, or Firm* — David B Gornish; Eckert Seamans Cherin & Mellott LLC

(57) ABSTRACT

A dispenser assembly having a container and an insert secured within the container. The insert includes a product cartridge defining a product containing space and a dispensing body having a dispenser receptacle. The product containing space has a first opening through which product exits, and the dispenser receptacle has a second opening at least partially offset from the first opening through which product enters the dispenser receptacle. The dispenser assembly further includes a push-button assembly attacked to the insert, including a button that moves between first and second positions. The button has an orifice defined therein in communication with one of the first or second openings when in the first position and with the other of the first or second openings when in the second position, such that the button permits transmittal of product between the first and second openings when moved between the first and second positions.

20 Claims, 16 Drawing Sheets

(52) U.S. Cl.
CPC ..... *B65D 2583/049* (2013.01); *B65D 2583/0436* (2013.01); *B65D 2583/0481* (2013.01)

(58) Field of Classification Search
USPC ..... 221/7, 8, 197, 256; 220/820
See application file for complete search history.

(56) References Cited

U.S. PATENT DOCUMENTS 3,831,808 A * 8/1974 Bender ..... A61J 7/04 221/197
5,048,720 A 9/1991 Hoke
5,148,944 A * 9/1992 Kaufman ..... A61J 7/0084 221/131
5,230,440 A * 7/1993 Kurokawa ..... B65D 83/0418 221/198
5,860,561 A 1/1999 Saldana
5,931,302 A * 8/1999 Isaacs ..... B65D 83/0409 206/538
6,131,765 A * 10/2000 Barry ..... A47F 1/035 221/264
6,206,235 B1 * 3/2001 Green ..... B65D 83/0409 221/204
6,763,971 B1 * 7/2004 Tong ..... G07F 11/44 221/151
6,929,158 B2 * 8/2005 Smiley ..... G01F 11/18 222/366
7,077,353 B1 * 7/2006 Veno ..... G11B 23/045 242/338.2
7,104,417 B2 * 9/2006 Hilliard ..... B65D 83/0454 221/25
7,360,669 B2 4/2008 Drajan
7,533,785 B2 * 5/2009 Smith ..... B65D 83/0409 221/263
8,100,288 B2 1/2012 Giraud et al.
8,397,946 B2 * 3/2013 Portney ..... B65D 83/0454 221/113
8,695,469 B2 * 4/2014 Webb ..... A61F 15/002 83/225
8,944,282 B2 * 2/2015 Kroupa ..... B65D 83/0409 221/154
9,010,571 B2 * 4/2015 Bailey ..... B65D 83/0409 221/260
2008/0230556 A1 9/2008 Kroupa et al.
2009/0194556 A1 * 8/2009 Klein ..... B65D 50/062 221/154
2009/0223989 A1 9/2009 Gelardi
2011/0073610 A1 3/2011 Giraud et al.
2012/0055948 A1 * 3/2012 Leifeld ..... A61J 7/0076 221/1
2014/0203035 A1 * 7/2014 Giraud ..... B65D 35/28 221/197

* cited by examiner

DISPENSER

CROSS-REFERENCE TO RELATED APPLICATIONS

This application is a U.S. National Phase of International Application No. PCT/US2012/047001 filed Jul. 7, 2012, which claims priority to U.S. Provisional Patent Application No. 61/521,148 filed Aug. 8, 2011, which are incorporated herein by reference in their entirety.

FIELD OF THE INVENTION

The invention pertains to a dispenser assembly and a removable insert for a dispenser assembly.

BACKGROUND

Moisture tight containers of the "clamshell" and/or "flat pack" type are often formed of a base shell, lid shell, hinge and closure. Examples of clamshell type containers are disclosed in U.S. Patent Application Publication Nos. 2011/0073610, as well as U.S. Provisional Patent Application No. 61/660,922, and International Patent Application No. PCT/US2012/025813, each of which is incorporated by reference herein as if fully set forth. Such containers are useful for packaging foods, pharmaceuticals, tobacco products and confections, among other products. U.S. Provisional Patent Application No. 61/445,869 further discloses several embodiments of inserts for dispensing products contained within clamshell packages. These inserts control the dispensing of products from a product containing space of the dispenser to a dispenser receptacle, where the product can be accessed by a user. A need exists for a similar insert in which product can easily be replaced within the product containing space, and housed within moisture-tight environment until such placement or replacement within the product containing space.

SUMMARY

The present invention relates to a dispenser assembly. The dispenser assembly includes a container and an insert secured within the container. The insert includes a product cartridge defining a product containing space and a dispensing body having a dispenser receptacle. The product containing space has a first opening through which product exits from the product containing space during a dispensing operation and the dispenser receptacle has a second opening through which product enters the dispenser receptacle. According to certain embodiments, the first opening is at least partially offset from the second opening. The dispenser assembly further includes a push-button assembly. The push-button assembly includes a button that moves between a first position and second position. The push-button assembly includes an orifice that is in communication with one of the first or second openings when the button is in the first position and in communication with the other of the first or second openings when the button is in the second position, such that the push-button assembly permits transmittal of product between the first and second openings when moved between the first and second positions.

The present invention further relates to a removable insert for a dispenser assembly. The insert includes a product cartridge defining a product containing space. A product cartridge opening is defined therein in communication with the dispenser assembly. The insert further includes a door that moves from a closed position to an opened position when the insert is placed within a container of the dispenser assembly.

DETAILED DESCRIPTION OF THE PREFERRED EMBODIMENTS

Figure 1:
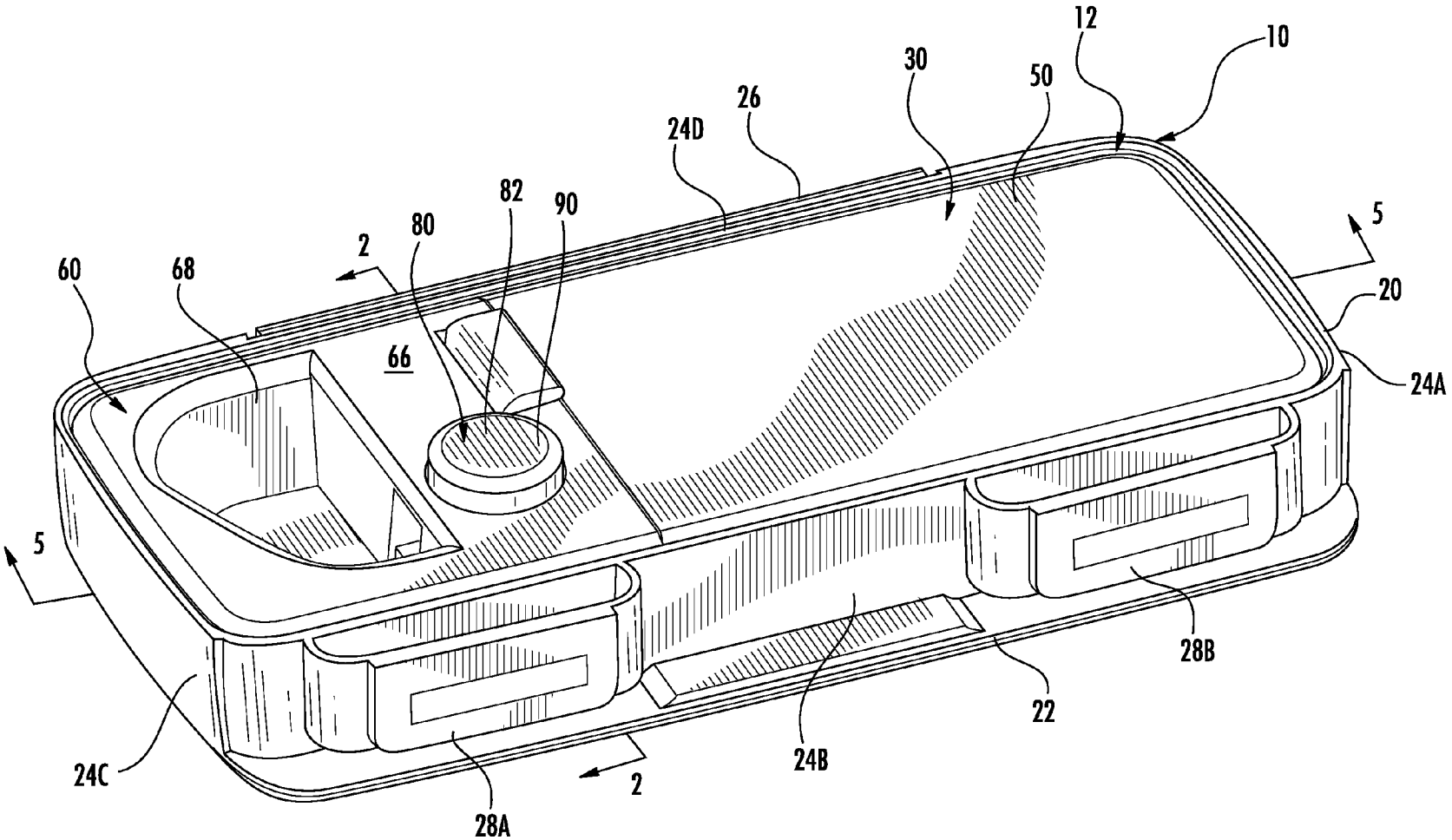
FIG. 1 is a top perspective view of an embodiment of a dispenser assembly.

Certain terminology is used in the foregoing description for convenience and is not intended to be limiting. Words such as "front," "back," "top," and "bottom" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

An embodiment of a dispenser assembly 10 in accordance with the invention is shown in FIGS. 1-6. As shown, the dispenser assembly includes a container base 20 and a dispensing insert 12 for insertion into the container base 20. The dispensing insert 12 includes a removable product cartridge 30, a dispensing body 60, and a push-button assembly 80.

Figure 7:
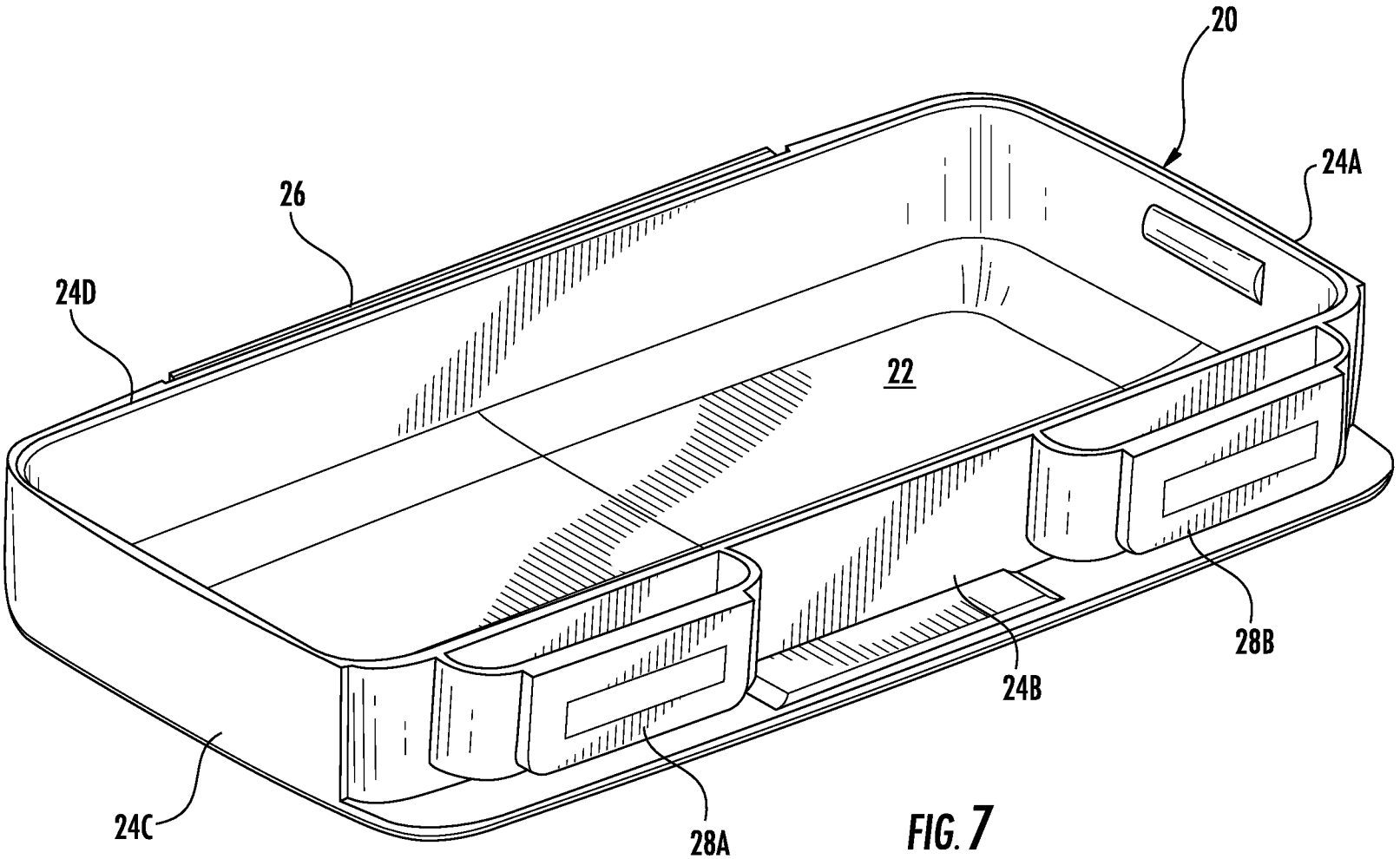
FIG. 7 is a top perspective view of an exemplary container base for use with the dispenser assembly.
Figure 8:
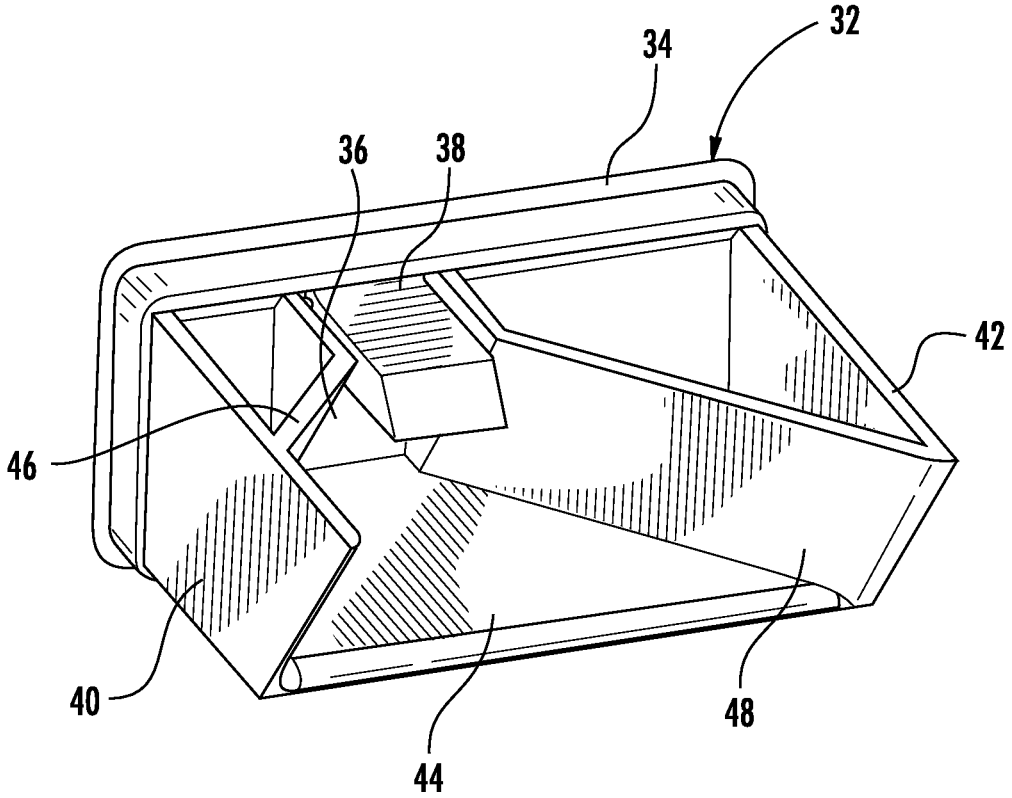
FIG. 8 is a left-side rear perspective view of the product cartridge front assembly of the dispenser assembly.
Figure 9:
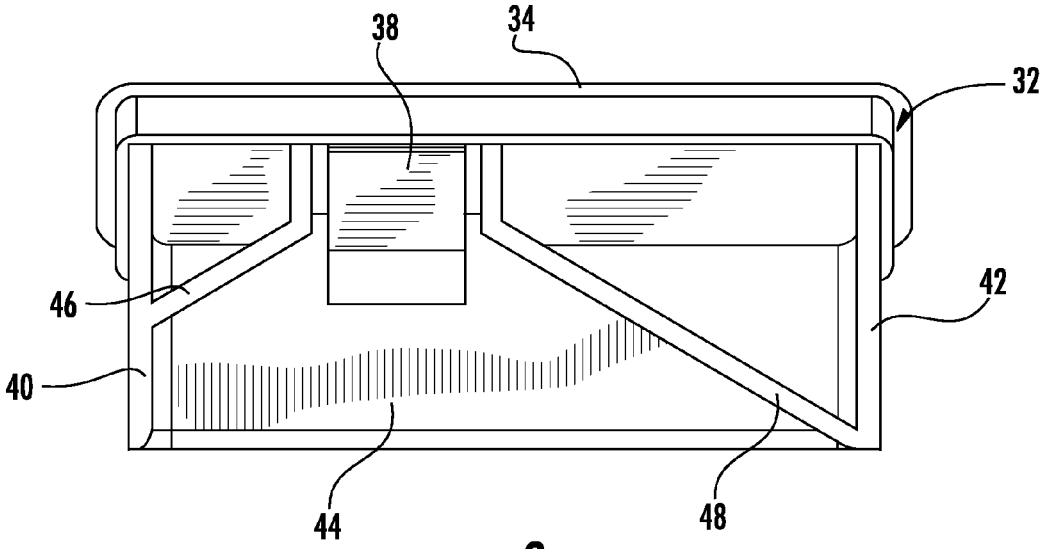
FIG. 9 is a top plan view of the product cartridge front assembly of FIG. 8.
Figure 10:
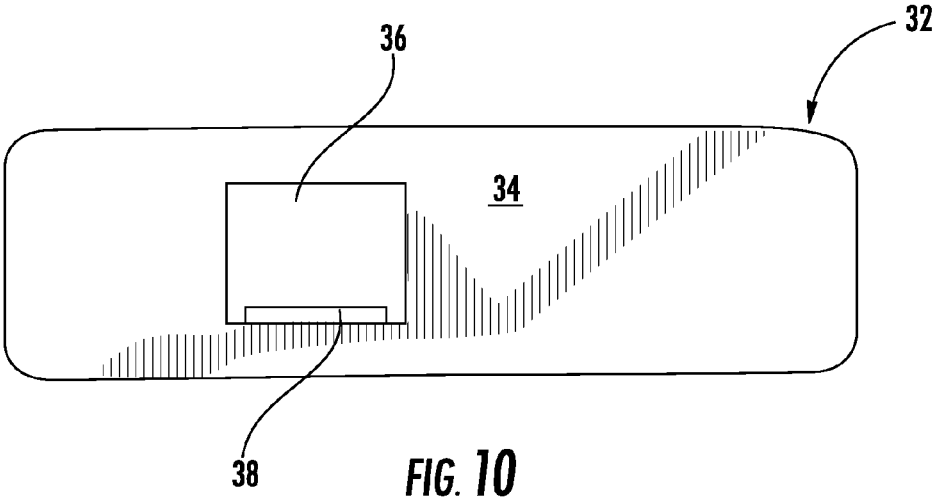
FIG. 10 is a front elevation of the product cartridge front assembly of FIG. 8.
Figure 11:
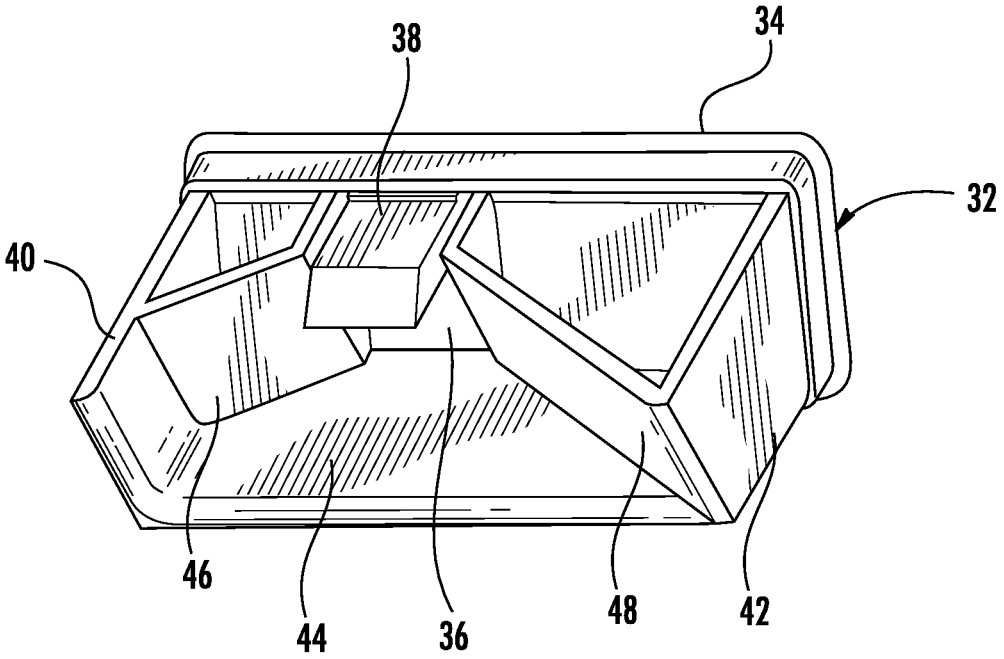
FIG. 11 is a right-side rear perspective view of the product cartridge front assembly of FIG. 8.

Referring first to FIG. 7, an exemplary container base 20 for use with a dispenser assembly in accordance with the invention is shown. As shown, the container base 20 includes a bottom wall 22, and four upwardly depending side walls 24A-D. A hinge 26 may be provided for attachment of a container lid. Release buttons 28A, 28B may be provided for permitting detachment of the container base 20 from a lid during opening of the dispenser assembly. While one configuration of a container base is shown in detail in FIG. 7, is should be understood that the dispensing system of the invention can be used with various types of containers having the base shown in the drawings, as well as other configurations of bases. Other examples of suitable containers and container bases are disclosed in U.S. Pat. No. 8,100,288, U.S. Patent Application Publication No. 2011/0073610, as well as U.S. Provisional Patent Application No. 61/660,922, each of which is incorporated by reference herein as if fully set forth. The container base 20 of the invention is configured to house the dispensing insert 12, including a removable product cartridge 30, dispensing body 60, and push-button assembly 80, all described in detail below.

Figure 12:
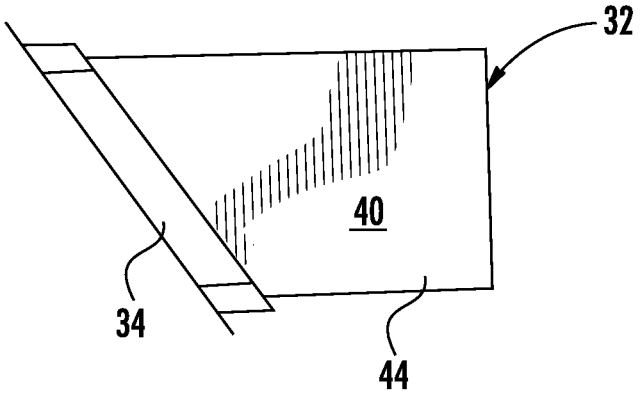
FIG. 12 is a right-side elevation of the product cartridge front assembly of FIG. 8.

FIGS. 8-15 show the components of the product cartridge 30 in detail. As shown, the product cartridge 30 includes a front assembly 32 and a housing 50. As shown in FIGS. 3-6, when the dispensing insert 12 is placed in the container base 20, the front assembly 32 of the product cartridge 30 is adjacent to the dispensing body 60. As shown in FIGS. 8-12, the front assembly 32 includes a front wall 34 having a first opening 36. A door 38 is pivotally attached to a top edge of the opening 36. Opposing side walls 40, 42 extend from the front wall 34, as does a bottom wall 44 that joins the side walls 40, 42. Support walls 46, 48 may be provided at angles extending between the side walls 40, 42 and the bottom wall 44. As best shown in FIG. 12, the front wall 34 extends from the bottom wall 44 at an angle.

Figure 13:
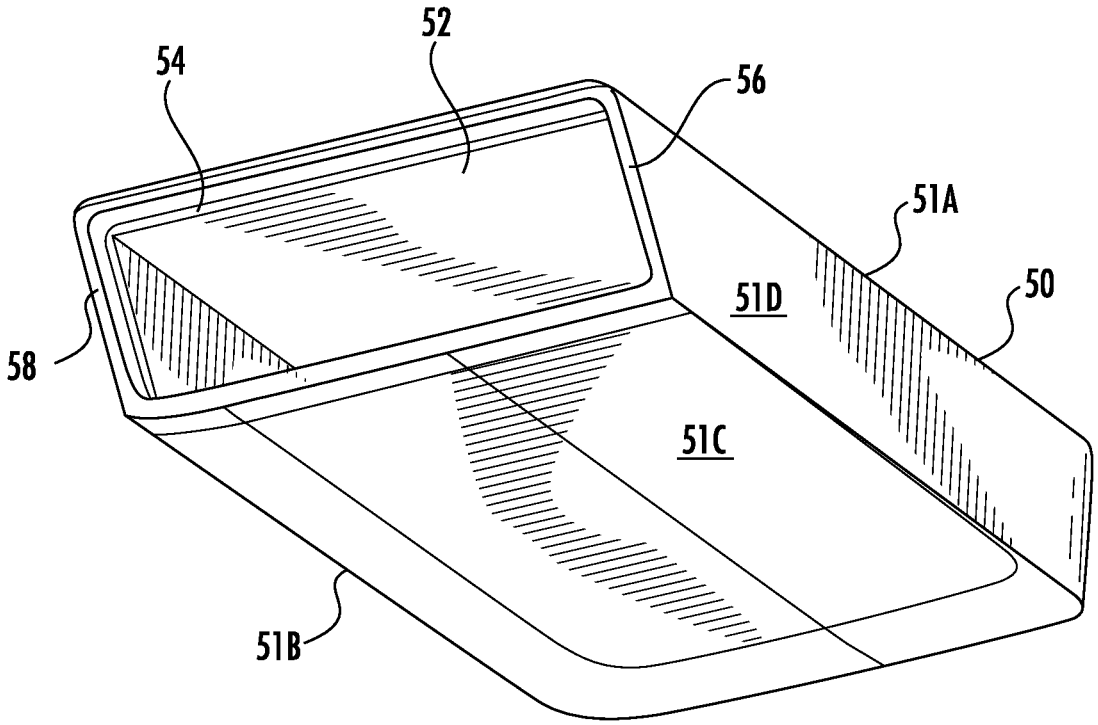
FIG. 13 is a front perspective view of the product cartridge housing of the dispenser assembly.
Figure 14:
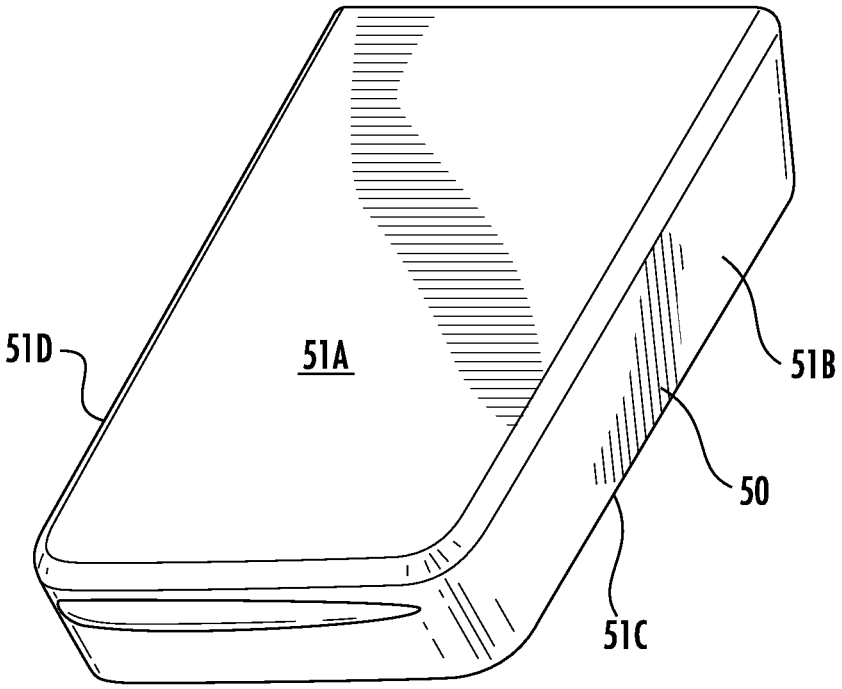
FIG. 14 is a rear perspective view of the product cartridge housing of FIG. 13.
Figure 15:
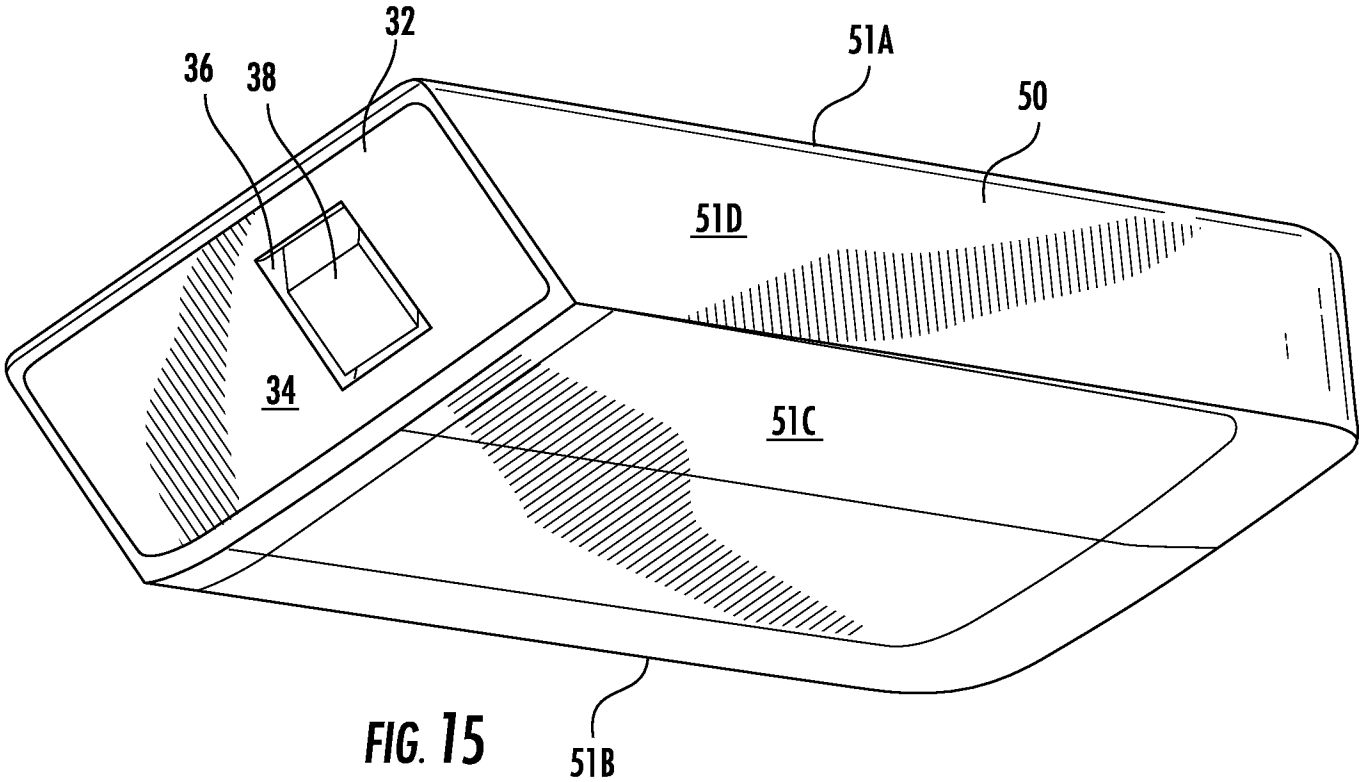
FIG. 15 is a bottom perspective view of the product cartridge front assembly assembled on the product cartridge housing.

The housing 50 is shown in detail in FIGS. 13-15. As shown, the housing 50 includes sidewalls 51A-D that define a product containing space 52 within the housing 50 for housing products to be dispensed using the dispenser assembly 10. The housing 50 is shaped to fit within and occupy a portion of the container base 20. In the embodiment shown, the container base 20 has a generally rectangular shape, and a portion of the housing 50 has a similar mating outer shape that is configured to fit within the side walls 24A-C of container base 20. The sidewalls 51A-D also define an opening 54 at a front portion of housing 50 at a location that, when the housing is properly positioned in the product cartridge 30, would be located within a central portion of the container base 20 (i.e., not against a side wall 24A-D). The opening 54 is configured to receive the insertion of at least the side and bottom walls 40, 42, 44 of the front assembly 32. Additionally side edges 56, 58 along the opening 54 are disposed at the same angle as front wall 34 of front assembly 32, so that the front wall 34 can fit flush up against the edges 56, 58 and cover at least a portion of the opening 54, as shown in FIG. 15.

Figure 19:
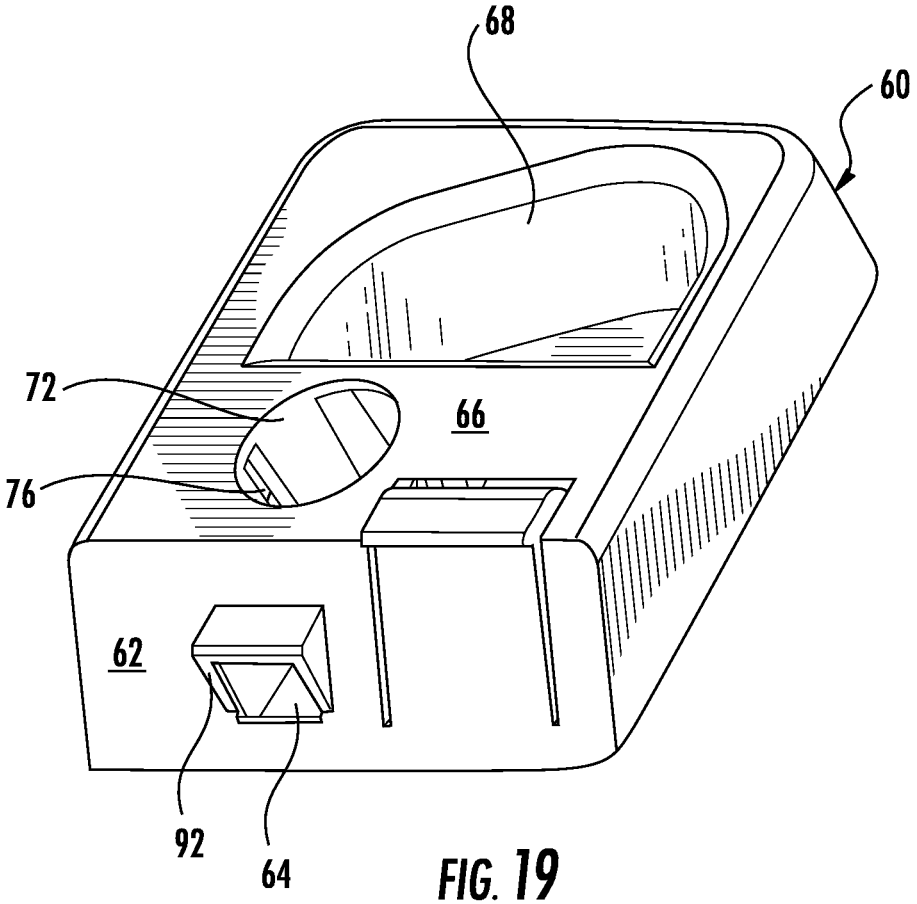
FIG. 19 is a rear perspective view of the dispensing body of the dispenser assembly.
Figure 20:
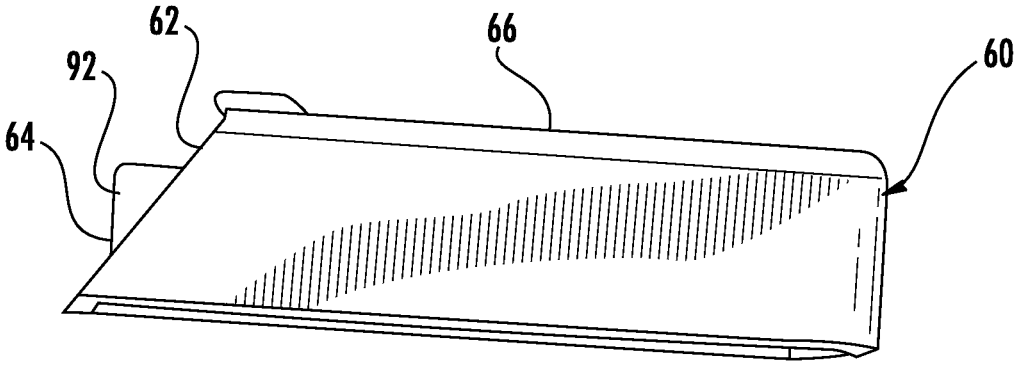
FIG. 20 is a right-side elevation of the dispensing body of FIG. 19.
Figure 21:
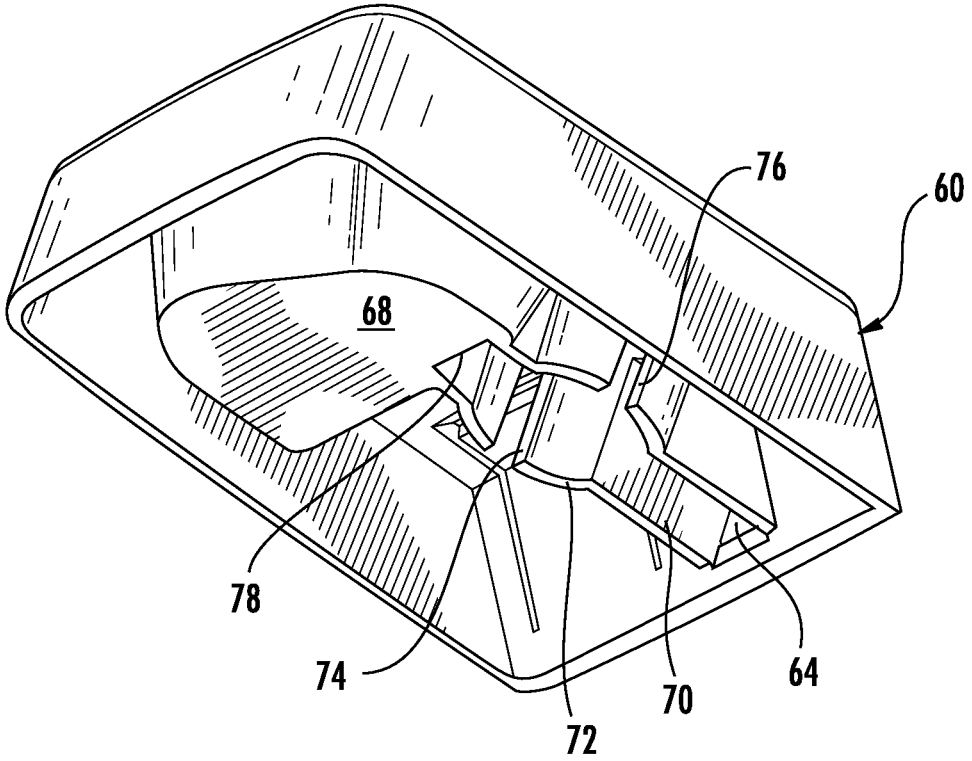
FIG. 21 is a bottom perspective view of the dispensing body of FIG. 19.

The dispensing body 60 is shown in detail in FIGS. 19-21. As shown, the dispensing body 60 includes a rear wall 62 disposed at an angle complementary to that of the front wall 34 of the cartridge front assembly 32. According to an embodiment, the dispensing body 60 is of a shape suitable to substantially occupy the space inside the container base 20 that is not occupied by the cartridge housing 50, forming a portion of the rectangular shape thereof in the illustrated embodiment. When the dispensing body 60 and the cartridge 30 are inserted into the container base 20, as shown in FIG. 1, the cartridge front wall 34 and dispensing body rear wall 62 are in abutment. An opening 64 is positioned in the dispensing body rear wall 62 at a location corresponding to that of the first opening 36 in the front wall. A hood 92 extends over and partially around the opening 64, extending outward from the rear wall 62. A top wall 66 extends generally horizontally across the top of the dispensing body 60 and defines a top surface thereof. A dispenser receptacle 68 for accessing a dispensed product 14 extends from the top wall 66 and into the dispensing body 60. As shown in FIG. 21, a passage 70 extends between the opening 64 in the dispensing body rear wall 62 and a second opening 78 formed in dispenser receptacle 68. The passage 70 and mating openings 36, 64 permit products 14 to travel from the cartridge 30 to the dispenser receptacle 68 during dispensing, as described in detail below.

Figure 16:
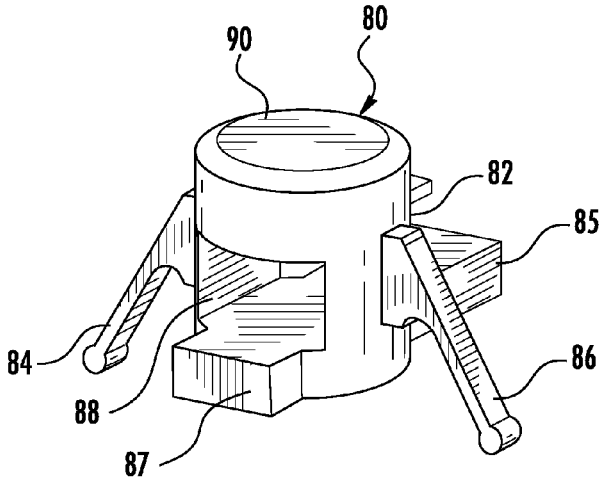
FIG. 16 is a rear perspective view of the push-button assembly of the dispenser assembly.
Figure 17:
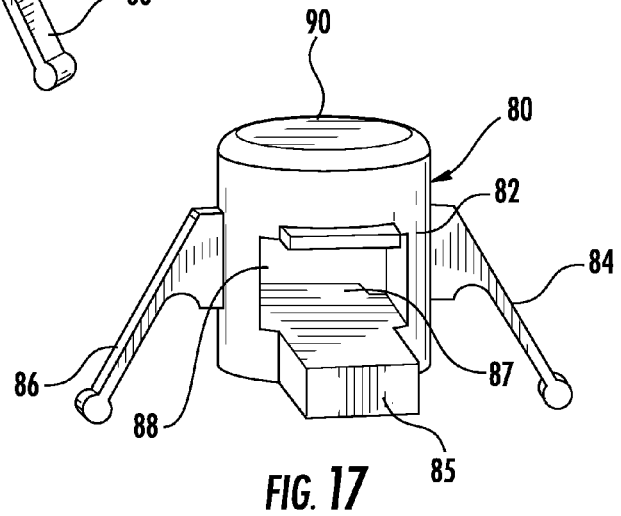
FIG. 17 is a rear perspective view of the push-button assembly of FIG. 16.
Figure 18:
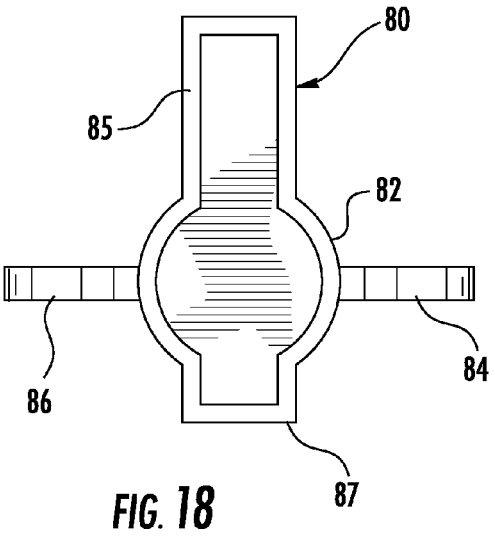
FIG. 18 is a bottom plan view of the push-button assembly of FIG. 16.

According to the illustrated embodiment, the passage 70 includes a sleeve 72 that is configured to allow the slidable displacement of at least a portion of a push-button assembly 80. The push-button assembly 80, as shown in FIGS. 16-18, includes a button 82, at least one spring 84, 86, and an orifice 88. The orifice 88 may be defined within or beneath the button 82. According to certain embodiments, the push-button assembly 80 may also include a leg 85 positioned beneath the orifice 88. The push-button assembly 80 is located within, and interrupts passage 70. At least a portion of the orifice 88 may be positioned within cylindrical wall of the button 82 and is sized to receive one or more pieces of product 14. At least a portion of the push-button assembly 80 is housed within the sleeve 72 of the dispensing body 80, which has a shape complementary to that of the button 82. Further, in embodiments that include a leg 85, at least a portion of the leg 85 may be configured to fit within a portion of the passage 70 so as block the passage of product 14 through the passage 70 when the push button assembly 80 is in a first, or vertically upward, position. Additionally, according to certain embodiment, the leg 85 may also provide a support for the product 14 as the product 14 is upwardly or downwardly displaced during the dispensing process, as discussed below. An actuation portion 90 protrudes from the top of the sleeve and above top wall 66 of dispensing body so that it can be depressed, causing the button 82 to move vertically downward from the first position, as shown in FIGS. 1-5, to a second, or vertically downward, position, as shown in FIG. 6. When in the second position, at least a position of the orifice 88 is generally aligned with the passage 70 so as to allow the movement of product 14 through the passage 70 and into the orifice 88. According to the embodiment illustrated in FIGS. 16-18, the push-button assembly 80 includes two springs 84, 86. In the embodiment shown, the springs 84, 86 are formed as legs that extend from opposite side surfaces of the cylindrical wall of the button 82 at angles outward and downward therefrom. Ends of each of the springs 84, 86 abuts the bottom wall 22 of the container base 20 to bias the push-button assembly 80 to the first or closed position, as shown in FIGS. 1-5. The springs 84, 86 extend through slots 74, 76 defined in the sleeve 72 of the dispensing body 60. Additionally, the push button assembly 80 may include a ledge 87 that is configured to engage the dispenser body 60 so as to control the position of the orifice 88 when the push button assembly 80 is in the first position.

As mentioned above, the cartridge 30 houses product 14 for dispensing with the dispenser assembly 10 of the invention. In one embodiment, the cartridge 30 is supplied as a replaceable component, pre-filled with product 14, while the container base 20 and/or dispensing body 60 assemblies are supplied as reusable components. According to such an embodiment, the cartridge 30 can be initially provided as a sealed assembly, for example in a sealed disposable package. It can then be removed from the package and inserted into the dispenser assembly 10 for dispensing by a user, in which it is then housed in a sealed container to preserve the product 14.

Figure 3:
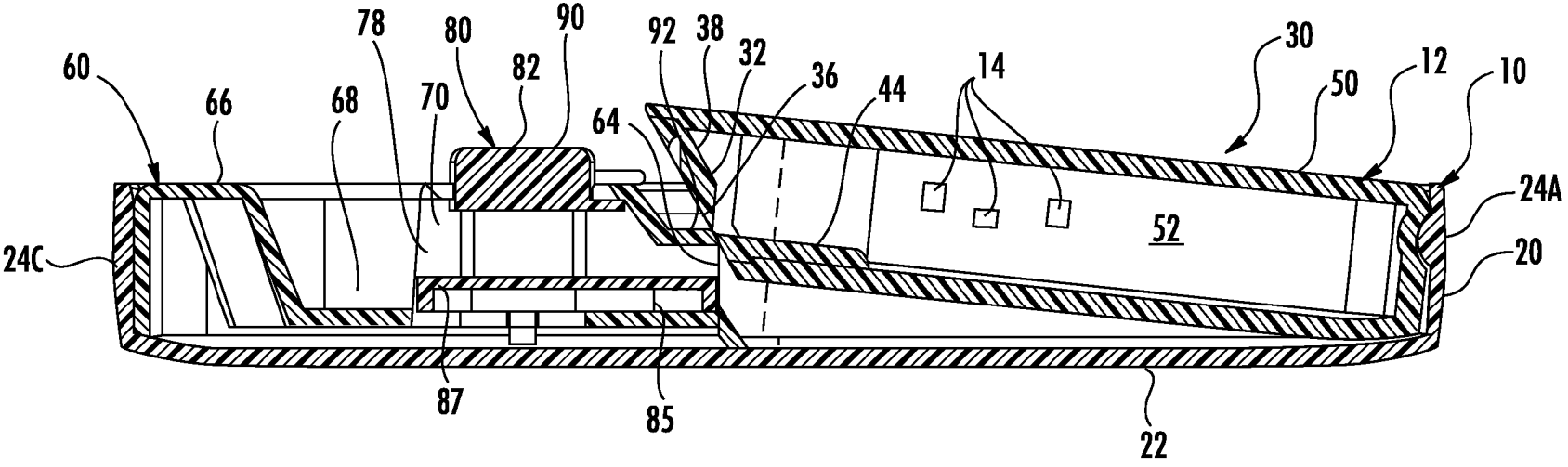
FIG. 3 is a longitudinal cross section of the dispenser assembly of FIG. 1, with the product cartridge partially inserted into the container base.
Figure 4:
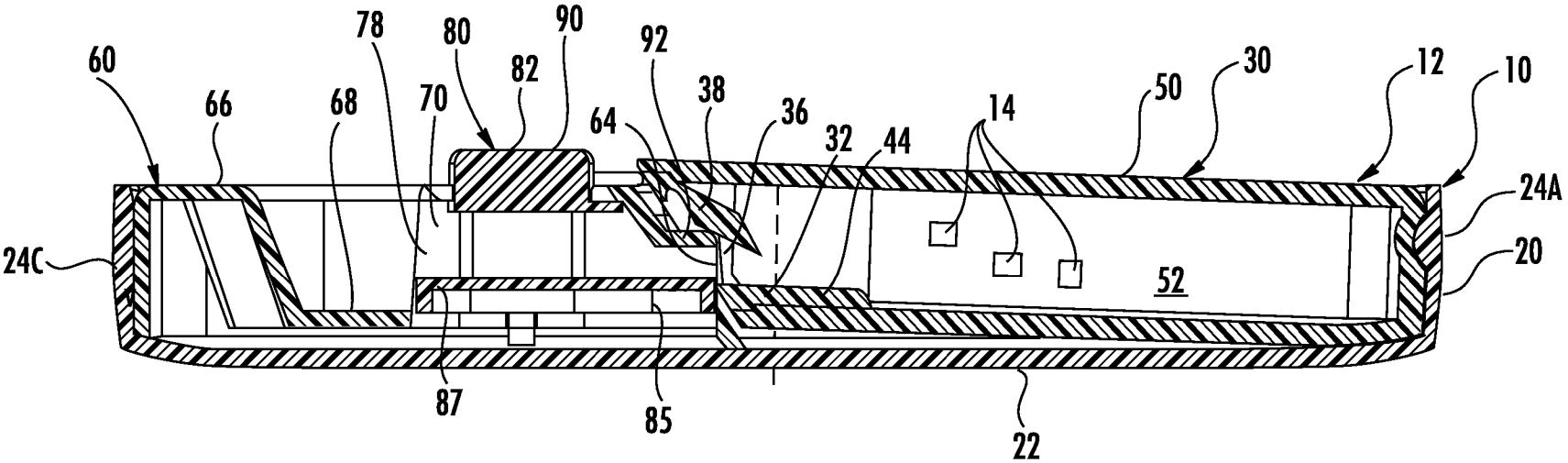
FIG. 4 is a longitudinal cross section of the dispenser assembly, as shown in FIG. 3, at a subsequent stage of insertion of the product cartridge into the container base.
Figure 5:
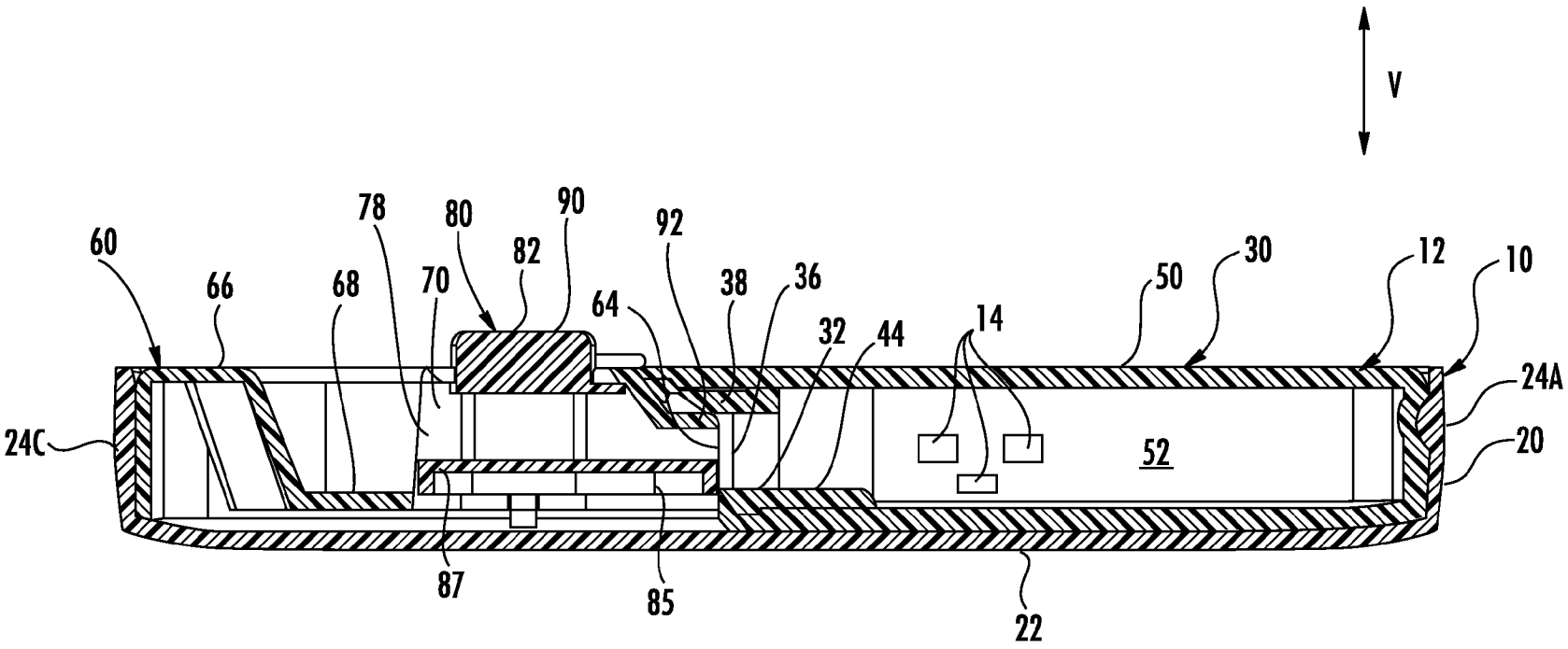
FIG. 5 is a longitudinal cross section taken along line 5-5 of FIG. 1, showing the dispenser assembly with the product cartridge fully inserted in the container base.
Figure 6:
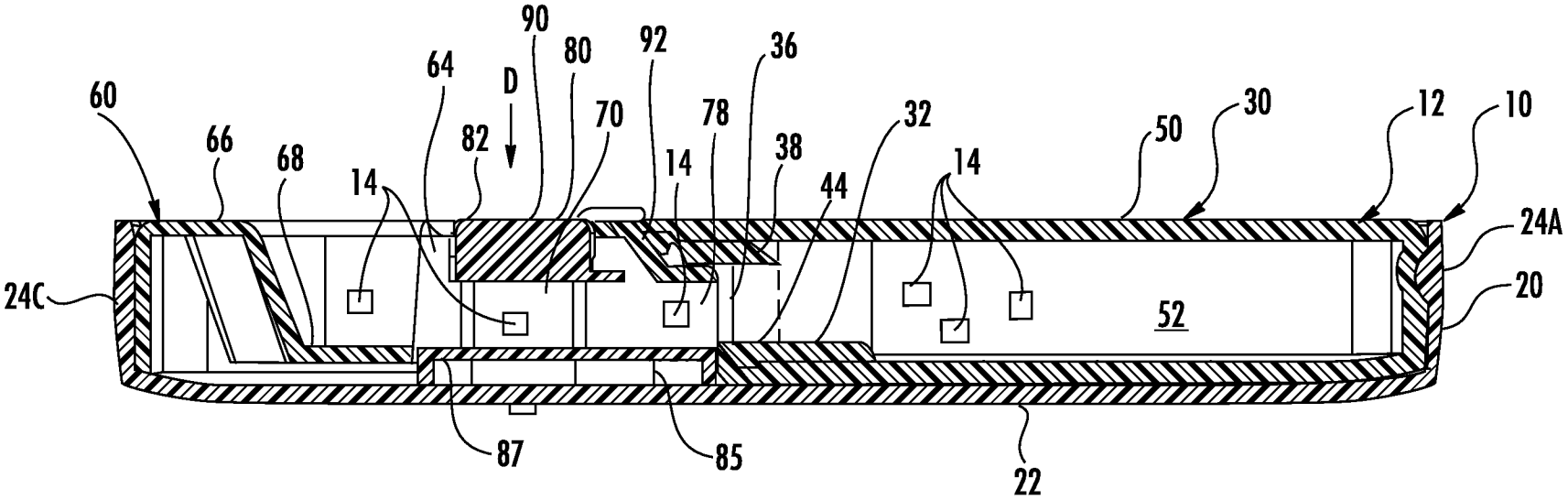
FIG. 6 is a longitudinal cross section of the dispenser assembly, as shown in FIG. 1, showing the product cartridge fully inserted in the container base and the push-button in a depressed position to permit dispensing of product.

Referring to FIGS. 3-5, assembly of the cartridge 30 in the container base 20 will be described in detail. FIG. 3 shows the cartridge 30 partially inserted into the container base 20. At this stage the door 38 is maintained in a closed position to retain products 14 within the product containing space 52. FIG. 4 shows a subsequent stage of insertion of the cartridge 30 into container base 20. At this stage the hood 92 of the dispensing body rear wall 62 contacts the cartridge door 38, causing it to pivot inward with respect to the cartridge 30, exposing the first opening 36. In FIG. 5 the cartridge 30 is fully inserted into the container base 20, and the door 38 is maintained in a fully opened position by hood 92, allowing product 14 to pass through the openings 36, 64 during dispensing.

Figure 2:
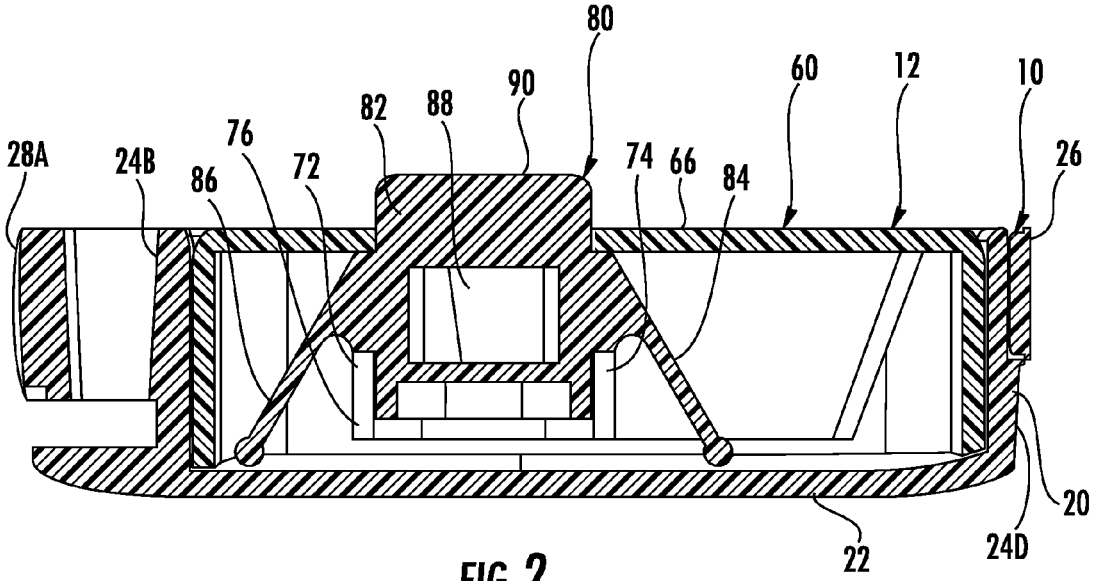
FIG. 2 is a cross section taken along line 2-2 of FIG. 1.

With reference to FIGS. 2, 5 and 6, the dispensing operation of the dispenser assembly 10 will be described in detail. As shown in FIGS. 5 and 6, according to certain embodiments, the second opening 78 of the dispenser receptacle 68 is offset from the first opening 36 of the product cartridge 30 in a vertical direction (as indicated by "V" in FIG. 5) so that the bottom of the first opening 36 is at a lower height than second opening 78. Moreover, the openings 36, 78 are offset by a distance sufficient to prevent the passing of product 14 from the product containing space 52 to the dispenser receptacle 68, absent displacement of the push-button assembly 80. Additionally, the push-button assembly 80 is configured to block passage of product 14 between the openings 36, 78, when in the position shown in FIGS. 1, 2 and 5. According to other embodiments, the first and second opening 36, 78 may not be vertically displaced, or, the first opening 36 may be at a higher height than the second opening 78. According to such embodiments, when the push button assembly 80 is displaced to the second position, product 14 may pass through the orifice 88 and continue traveling to the dispenser receptacle 68.

According to the illustrated embodiment, to initiate a dispensing operation, a user may depress the button 82 in direction D, shown in FIG. 6, thereby aligning and placing orifice 88 in communication with the first opening 36. The user may then tilt the package so that at least one piece of product 14 contained in the product containing space 52 travels through the openings 36, 64 to the passage 70 and enters the orifice 88 and is positioned on the leg 87. The user may then release the button 82, thereby allowing the springs 84, 86 to force the push-button assembly 80 upward, so that the orifice 88 is generally aligned and in communication with the second opening 78 of the dispenser receptacle 68. The user may then tilt the package, or the product 14 may then move, out of the orifice 88 and into the dispenser receptacle 68, where it can be removed by the user.

According to another embodiment, rather than being a push-button, the button 82 may rotate in a generally circular direction. According to such an embodiment, the openings 36, 78 may or may not be offset in the vertical direction. The orifice 88 in the button 82 may be biased by, among others, a spring or coil, so as to be biased in communication with either of the openings 36, 78. According to an embodiment in which the orifice 88 is biased in communication with the dispenser receptacle second opening 78, the button 82 is rotated until the orifice 88 is in communication with cartridge first opening so that product 14 contained in the product containing space 52 may be moved into the orifice 88. Once product 14 has been placed in the orifice 88, the button 82 may be released, after which the button 82 rotates so that the orifice 88 returns to being into communication with the dispenser receptacle opening 68, and the product 14 contained in the orifice 68 may be moved into the dispenser receptacle 68.

While the preferred embodiments of the invention have been described in detail above, the invention is not limited to the specific embodiments described, which should be considered as merely exemplary.

REFERENCE NUMBER LIST

| | |
|---|---|
| 10 | Dispenser assembly |
| 12 | Dispensing Insert |
| 14 | Product |
| 20 | Container Base |
| 22 | Bottom Wall |
| 24A-D | Side Walls |
| 26 | Hinge |
| 28A-B | Release Buttons |
| 30 | Product Cartridge |
| 32 | Front Assembly |
| 34 | Front Wall |
| 36 | First Opening |
| 38 | Door |
| 40 | Side Wall |
| 42 | Side Wall |
| 44 | Bottom Wall |
| 46 | Support Wall |
| 48 | Support Wall |
| 50 | Housing |
| 52 | Product Containing Space |
| 51 | Sidewall |
| 54 | Opening |
| 56 | Side Edge |
| 58 | Side Edge |
| 60 | Dispensing body |
| 62 | Rear Wall |
| 64 | Opening |
| 66 | Top Wall |
| 68 | Dispenser Receptacle |
| 70 | Passage |
| 72 | Sleeve |
| 74 | Slot |
| 75 | Leg |
| 76 | Slot |
| 78 | Second Opening |
| 80 | Push-Button Assembly |
| 82 | Button |
| 84 | Spring |
| 86 | Spring |
| 87 | Ledge |
| 88 | Orifice |
| 90 | Actuation Portion |
| 92 | Hood |

What is claimed is:

1. A dispenser assembly for dispensing a plurality of product units, comprising:

a container base;

a removable cartridge having a product containing space for the plurality of product units and a first opening, the removable cartridge being removably disposed in the container base;

a dispensing body being disposed in the container base, the dispensing body having a second opening leading to a dispenser receptacle for accessing dispensed product units;

a button assembly, at least a portion of which is disposed in the container base between the removable cartridge and the dispenser receptacle, the button assembly comprising a button that moves between a first position and second position, the button assembly having an orifice that moves with the button that is in communication with the first opening when the button is in the first position and in communication with the second opening when the button is in the second position, wherein the orifice has a first orifice opening and a second orifice opening, such that the button permits transmittal of product units between the first and second openings, when the button assembly is moved between the first and second positions, wherein at least one of the product units enters the orifice through the first orifice opening and exits the orifice through the second orifice opening into the dispensing body, wherein the button assembly includes the button and at least one spring, wherein the button assembly is biased by the at least one spring toward the first position, and wherein, when the button assembly is moved between the first and second positions, the dispenser receptacle remains fixed with respect to the container base; and a door pivotably connected to an edge of the first opening of the removable cartridge, the door configured to be moved from a closed position that covers at least a portion of the first opening to an opened position when the product cartridge is placed in the container base, wherein the dispensing body comprises a hood that extends into the first opening to maintain the door in the opened position when the product cartridge is placed in the container base, the hood extending over and partially around the second opening of the dispensing body, and wherein, when the door moves from the closed position toward the opened position, the hood engages the door, thereby causing the door to pivot toward the product containing space.

2. The dispenser assembly of claim 1, wherein a passage extends between the first opening and the second opening.

3. The dispenser assembly of claim 2, wherein the button assembly is located within the passage.

4. The dispenser assembly of claim 1, wherein the at least one spring includes two springs extending from a side surface of the button.

5. The dispenser assembly of claim 1, wherein the button assembly is housed within a sleeve defined within the dispensing body.

6. The dispenser assembly of claim 1, wherein the orifice is in communication with the first opening when in the first position, and with the second opening when in the second position.

7. The dispenser assembly of claim 1, further comprising a container lid connected to the container base by a hinge.

8. The dispenser assembly of claim 7, wherein the container lid, when secured in a closed position, covers at least a portion of the removable cartridge and prevents removal of the removable cartridge from the container base.

9. The dispenser assembly of claim 8 further comprising at least one release button for releasing the lid from the closed position to enable removal of the removable cartridge from the container base.

10. The dispenser assembly of claim 1, wherein the button assembly comprises a push-button.

11. The dispenser assembly of claim 1, wherein the removable product cartridge is a disposable component of a reusable assembly.

12. The dispenser assembly of claim 1, wherein the removable product cartridge comprises a front assembly that fits at least partially in the first opening, the front assembly having a front wall having a front assembly opening.

13. The dispenser assembly of claim 12, wherein the front assembly opening is sized to permit passage of at least one product unit through the front assembly opening.

14. The dispenser assembly of claim 13, wherein the door is affixed over the front assembly opening.

15. The dispenser assembly of claim 1, wherein the first position is located vertically upwards of the second position.

16. The dispenser assembly of claim 1, wherein the removable product cartridge is pre-filled with the plurality of product units.

17. The dispenser assembly of claim 16, wherein the product units comprise a food product.

18. The dispenser assembly of claim 16, wherein the product units comprise a pharmaceutical product.

19. The dispenser assembly of claim 16, wherein the product units comprise a tobacco product.

20. The dispenser assembly of claim 16, wherein the product units comprise a confections product.

* * * * *